US006269904B1

(12) United States Patent
Morhaus

(10) Patent No.: US 6,269,904 B1
(45) **Date of Patent: *Aug. 7, 2001**

(54) TRUSS STYLE TROLLEY BEAM FOR A FALL PROTECTION SYSTEM

(75) Inventor: Daniel W. Morhaus, Glen Carbon, IL (US)

(73) Assignee: FPS Investments, LLC, Madison, IL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/031,634

(22) Filed: Feb. 27, 1998

(51) Int. Cl.[7] ..... E04G 1/00
(52) U.S. Cl. ..... 182/36; 212/346
(58) Field of Search ..... 182/36, 37, 38, 182/39, 142; 105/163.1, 163.2; 212/346

(56) References Cited

U.S. PATENT DOCUMENTS 2,639,950 * 5/1953 Wheeler ..... 182/37
3,294,252 * 12/1966 Hosoi et al. ..... 212/346 X
3,844,417 * 10/1974 Holm ..... 212/18
3,870,122 * 3/1975 Faucheux ..... 182/36
4,702,661 * 10/1987 Bisiach ..... 414/460
4,890,750 * 1/1990 Stern ..... 212/153
5,433,150 * 7/1995 Long, Jr. et al. ..... 105/163.2
5,492,067 * 2/1996 Anderson ..... 105/163.2
5,575,220 * 11/1996 Van Soest et al. ..... 212/346 X

OTHER PUBLICATIONS

DBI/SALA Fall Protection Systems for Railcar Applications dated May 1995.

* cited by examiner

*Primary Examiner*—Daniel P. Stodola
(74) *Attorney, Agent, or Firm*—Polster, Leider, Woodruff & Lucchesi

(57) ABSTRACT

A fall protection system has at least two widely spaced apart support members which support a rail assembly above a work area. The rail assembly includes a beam and a truss member. The beam has a generally vertical web and at least a lower generally horizontal flange. A trolley is adapted to slide or move across the flange. The truss member is mounted to a top of the beam and extends the length of the beam.

15 Claims, 3 Drawing Sheets

TRUSS STYLE TROLLEY BEAM FOR A FALL PROTECTION SYSTEM

CROSS-REFERENCE TO RELATED APPLICATIONS

Not Applicable

STATEMENT REGARDING FEDERALLY SPONSORED RESEARCH OR DEVELOPMENT

Not Applicable.

BACKGROUND OF THE INVENTION

This invention relates to fall protection systems, and in particular, to a truss-style trolley beam for fall a protection system.

The fall protection equipment industry in both the United States and abroad manufactures and installs several types of overhead fall protection systems. Fall protection systems are typically, though not exclusively, used to prevent workers from accidental falls from the tops of railroad cars, tanker trucks and similar rolling or stationary vehicles (used primarily during loading/unloading), and other stationary structures such as at the tops of tall silos and buildings and other structures that, while being traversed, provide fall hazards and may require supplemental protection for workers who traverse them.

Virtually all fall protection systems typically include a safety harness (which is worn by the user of the system) which is secured to a lanyard (often a spring loaded retractable webbed belt feeder) to restrain the worker from falling. The lanyard is also commonly referred to as a "lifeline". The lifeline portion of the lanyard is usually manufactured of nylon woven belt webbing or stainless steel cable. The safety harness is normally manufactured of nylon webbing material and is designed to distribute the loading stresses of a fall arrest toward the seat and thighs of a worker, thus preventing serious injury in the event of a fall.

Most applications for these systems also allow the worker to move with ease about the structure or vehicle being traversed, and the majority of these systems therefore include some sort of trolley, or traversing mechanism, which allows the worker to tether himself to the system and move about while maintaining constant protection in the event of a fall.

The most common fall protection system currently in use today is the "safety cable" system. In this system, a stainless steel cable (or a similar cable made of a synthetic material) is securely strung between two or more anchor points. A trolley mechanism is mounted on that cable to secure the lanyard and therefore support the worker in the event of a fall.

A second type of fall protection system, in limited commercial use today, is the trolley beam (or I-Beam) style system. The typical I-beam style fall protection system includes an I-beam supported above the structure to be traversed, a trolley which rides on the I-beam, and a safety harness which is worn by the worker. The trolley in the I-beam system is typically a four-wheeled device that is designed to ride on the lower leg or flange of the I-beam, and includes an attachment point (typically a carabiner) to secure the lifeline to the trolley.

Due to static loads and the loads placed on the I-beam when a worker falls, the I-beam is prone to flexing, sagging, drooping, warping or otherwise distorting. To overcome this, supporting members have to be installed every 6'–7' feet along the length of the I-beam to prevent the I-beam from flexing or otherwise distorting. Further, because of the flexing, the I-beam systems typically have a maximum weight allowance. These factors severely limit where I-beam style systems can currently be installed. Practical applications are limited to those in which the I-beam rail can be directly and securely attached to an existing structure. The only previously known and recognized means of mounting the I-beam was to hang the I-beam over the planned area by attaching it with bolts or welds directly onto existing steel roof beams, perlins, or other similar pre-existing structures already in place at the point of installation. Because of these limitations to the I-beam style fall protection system, the safety cable fall protection system has dominated the industry.

BRIEF SUMMARY OF THE INVENTION

A primary object of the present invention is to provide an I-beam style trolley fall protection system.

Another object is to provide such a fall protection system which can span long distances (i.e., more than about fifteen feet) without the need for frequent supports.

A further object is to provide such a fall protection system which can be made to be free standing.

A further object is to provide such a fall protection system which reduces the tendency of the I-beam to sag or bend.

These and other objects will become apparent to those skilled in the art in light of the following disclosure and accompanying drawings.

Until the invention of my integrated truss style trolley beam, most potential applications for fall protection systems were considered impractical for an I-beam type of fall protection system due to the above noted limitations in the system. Briefly, my integrated truss style trolley beam is a unique and innovative engineering development which integrates a standard I-beam into a custom designed, uniquely self-supporting structure, which can effectively span long distances while providing strong support for the I-beam.

The fall protection system comprises at least two spaced apart support members, a rail assembly mounted to the support members to be positioned over a work area, a trolley slideable along the rail assembly, a lanyard suspended from the trolley, and a harness connected to an end of the lanyard and adapted to be worn by a user. The support members are spaced at least 10' feet apart (and upwardly of 45–50' apart) and support the rail assembly above a structure to be traversed.

The rail assembly includes a beam and a truss member. The beam has a generally horizontal web secured to a bottom of the truss member. The trolley is slideable over or along the horizontal web of the beam. The truss member is mounted to a top of the beam and extends substantially the length of said beam.

The truss includes a truss frame having a first frame member and a second frame member which are spaced apart from each other above the beam. The frame members extend generally horizontally substantially the full length of the beam. The truss includes a plurality of connecting members extending between the first and second frame members in a zigzag fashion. The truss is completed by a second and third set of connecting members. The second set of connecting members extends between the first frame member and the beam. The third set of connecting member extends between the second frame member and the beam. The second and third set of connecting members also zigzag between the frame members and the beam to define a plurality of triangles. Preferably, the truss is generally triangular in end elevation. The lower or bottom ends of the second and third sets of connecting members thus converge toward each other and are located substantially adjacent each other at the point where they are connected to the beam. The frame members preferably are made from angles having an upper leg and a lower leg. The upper leg is generally horizontal and the lower leg defines an acute angle (preferably about 60°) with the upper leg. The second and third sets of connecting members are fixed to the frame member second legs. The angle defined by the legs is sized to direct the second and third sets of connecting members to the approximate center of the beam.

The truss is suspended from the support by a bracket assembly. The bracket assembly includes a bracket cross-member which extends between the frame members and a U-bolt to which the cross-members are connected. The U-bolt has a pair of legs connected by a spanner. The U-bolt legs extending downwardly from said support to be connected to the bracket cross-members. Preferably, the bracket includes a spacer on an upper surface of each frame member. The bracket cross-members are mounted to the spacer to be spaced above a top of said truss.

BRIEF DESCRIPTION OF THE SEVERAL VIEWS OF THE DRAWINGS

Corresponding reference numerals will be used throughout the several figures of the drawings.

DETAILED DESCRIPTION OF THE INVENTION

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode of carrying out the invention.

Figure 1:
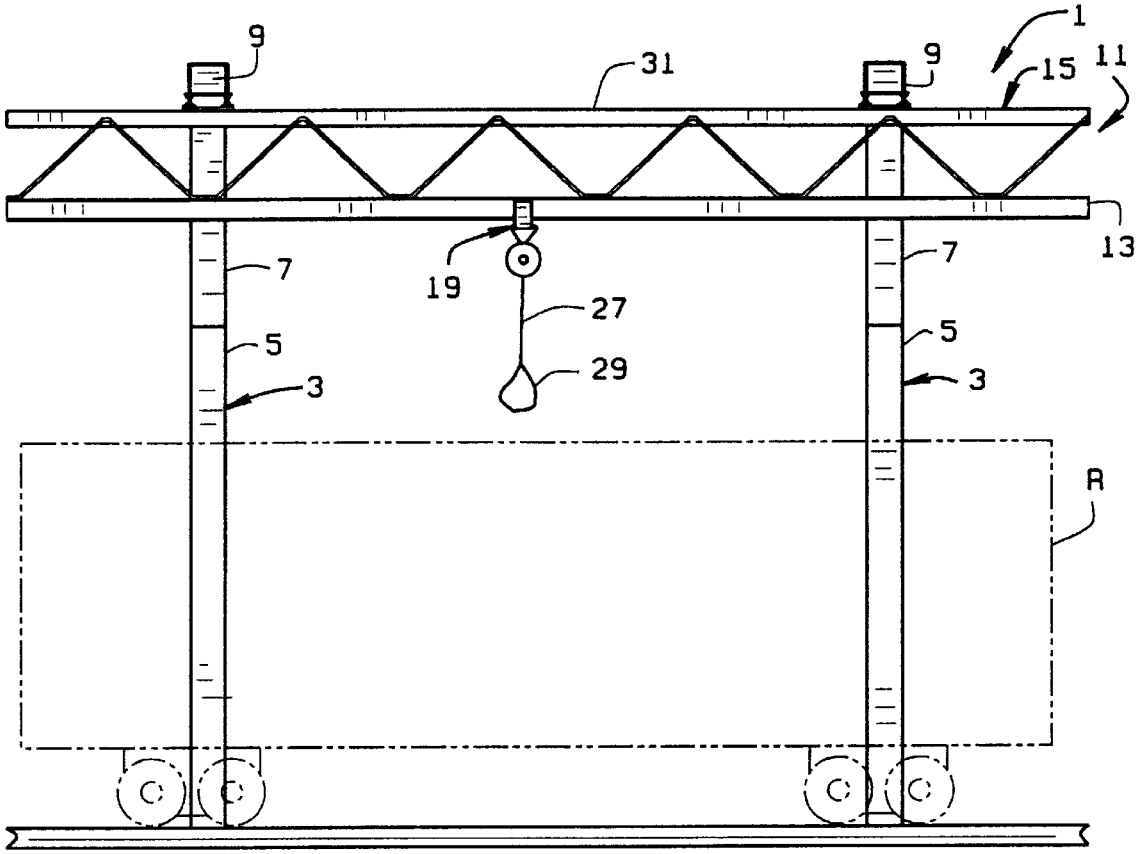
FIG. 1 is a side elevational view of a fall protection system of the present invention, the system being shown adjacent a railroad car.

A fall protection system 1 of the present invention is shown in FIG. 1 adjacent a rail car R. The fall protection system 1 could also be erected adjacent other moveable or stationary structures which need to be traversed by workers and which present fall dangers. The fall protection system 1 includes a spaced apart supports 3. The supports 3 are free standing supports which are anchored in the ground adjacent a structure (such as a railcar, hopper, silo, building, etc.) on which personnel will be working. The supports 3 each include a generally vertical section 5 which extends upwardly from the ground. An angled or sloped section 7 extends from the top of the vertical section 5 towards the structure on which the personnel will be working. Lastly, a generally horizontal section 9 extends from the end of the sloped section 7 out over the structure on which the personnel will be working. The vertical section 5 and the sloped section 7 have a combined height greater than the height of the structure. The vertical section 5 itself can have a height greater than the structure. The vertical section 5 is anchored in the ground at a position spaced away from the structure. The sloped section 7 is of a length so that its end is at least generally aligned with the side of the structure. Preferably, the end of the sloped section 7 is positioned over the structure. The horizontal section 9 extends to a position beyond the longitudinal center of the structure.

A rail assembly 11 is suspended from the horizontal section 9 of the supports 3 to be positioned over the structure. Preferably, the rail assembly is positioned over the longitudinal center of the structure and extends substantially the length of the structure. The rail assembly 11 includes a beam 13 and a reinforcing truss 15. The beam is preferably an I-beam and has a bottom, generally horizontal flange 16, a vertical web 17 extending upwardly from the flange 16, and an upper flange 18 which extends across the top of the web 17.

A trolley 19 is slideable along the flange 17 of the I-beam 13. Preferably, the trolley includes wheels 21 which enable the trolley to move freely along the I-beam. The trolley includes a plate assembly 23 which is generally V-shaped, and to which the wheels 21 are rotatably mounted. A mounting ring 25, such as a carabiner, is mounted to the bottom of the plate assembly, and a lanyard 27 is connected to and suspended from the ring 25. The lanyard 27 can be retractable, as shown, or of a fixed length. A safety vest or belt 29 is connected to the end of the lanyard 27 to be worn by the personnel working on the structure.

The truss 15 is shown to be generally triangular in end elevation. It includes a pair of spaced apart elongate upper frame members 31 which extend the length of the rail assembly 11 spaced above the beam top flange 18. The frame members 31 are spaced apart a distance greater than the width of the I-beam flange 18, preferably at least twice the width of the I-beam flange. The frame members 31 are preferably angle bars having an upper leg 31*a* and a lower leg 31*b*. Preferably, the legs 31*a* and 31*b* define an acute angle, preferably of about 60°. The upper legs 31*a* are generally horizontal and the lower legs 31*b* are directed inwardly and downwardly toward the I-beam 13.

A plurality of diagonally extending cross-members members 33 extend between the upper frame members 31. The cross-members 33 form a generally zigzag pattern made of a plurality of triangles having at least two sides of equal length. A series of spaced apart cross-members 35 extend between the frame members 31, and generally form right angles with the frame members 31. The cross-members 33 and 35 are fixed to the legs 31*a* of the members 31, such as by welding. Preferably, the cross-members 33 and 35 are fixed to the underside of the frame members 31.

A plurality of connecting members 41 and 43 extend between the frame members 31 and the beam 13. The connecting members 41 and 43 are welded to the I-beam top flange 18. The connecting members 41 and 43, like the connecting members 31 run diagonally between the frame members 31 and the beam 13 to form a zigzag pattern made of a plurality of triangles having at least two sides of equal length. To give the truss 15 its triangular shape, the connecting members 41 and 43 also slope inwardly from the frame members 31 to a position at the approximate axial center of the beam 13. The connecting members 41 and 43 are secured, such as by welding, to the lower legs 31*b* of the frame members 31. The frame members 31 are formed such that the angle defined by the legs 31*a* and 31*b* will direct the connecting members 41 and 43 towards the center of the I-beam. This allows for the connecting members 41 and 43 to be fixed to the member leg 31*b* over a substantial width of the leg 31*b*. Stated differently, the connecting members 41 and 43 are generally parallel to, and lie in substantially the same plane as, the frame member legs 31*b*. Thus, there will be more than just a point contact between the connecting members 41 and 43 and the frame member legs 31*b*.

Figure 2:
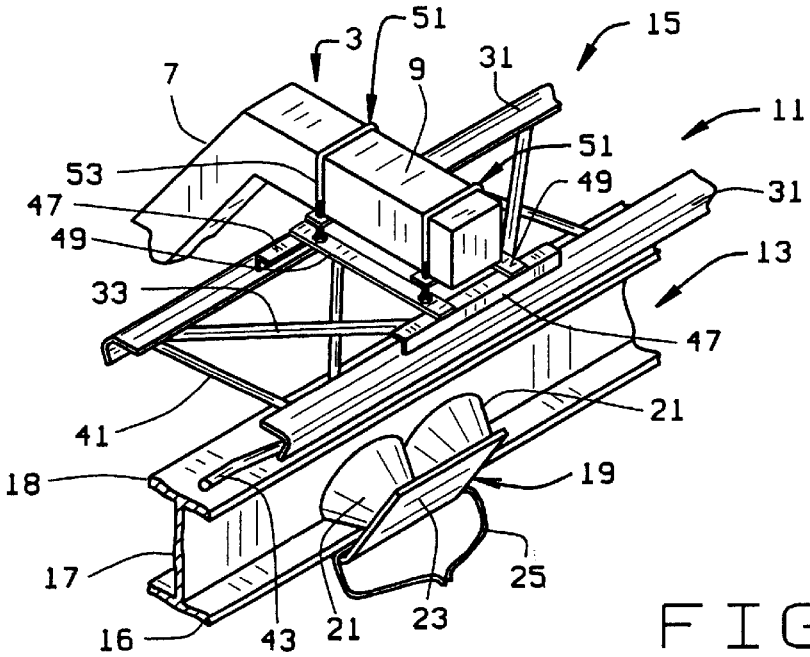
FIG. 2 is an enlarged, fragmentary, perspective view of the beam and truss of the fall protection system.
Figure 3:
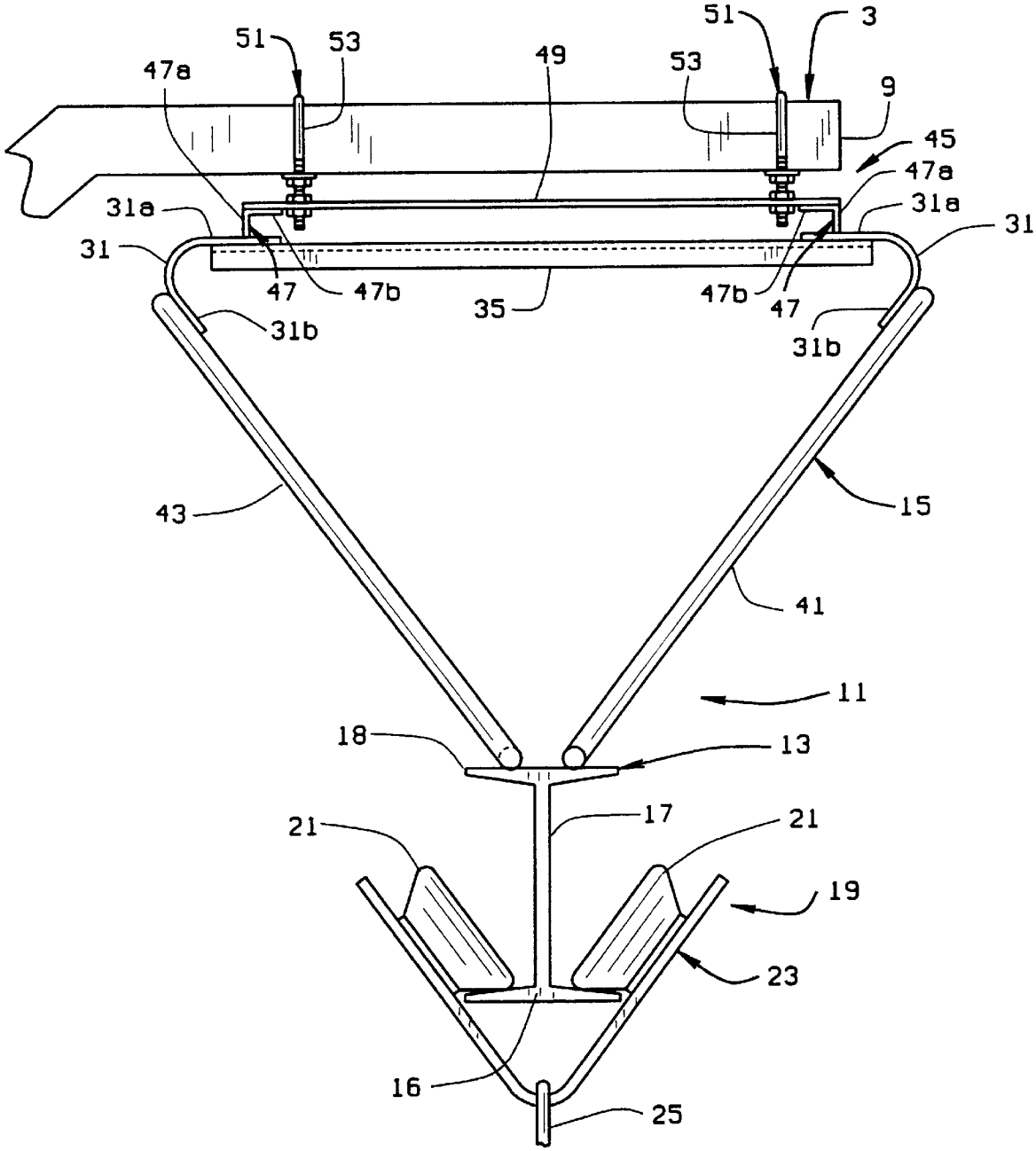
FIG. 3 is an end elevational view of the beam and truss of the fall protection system.
Figure 4:
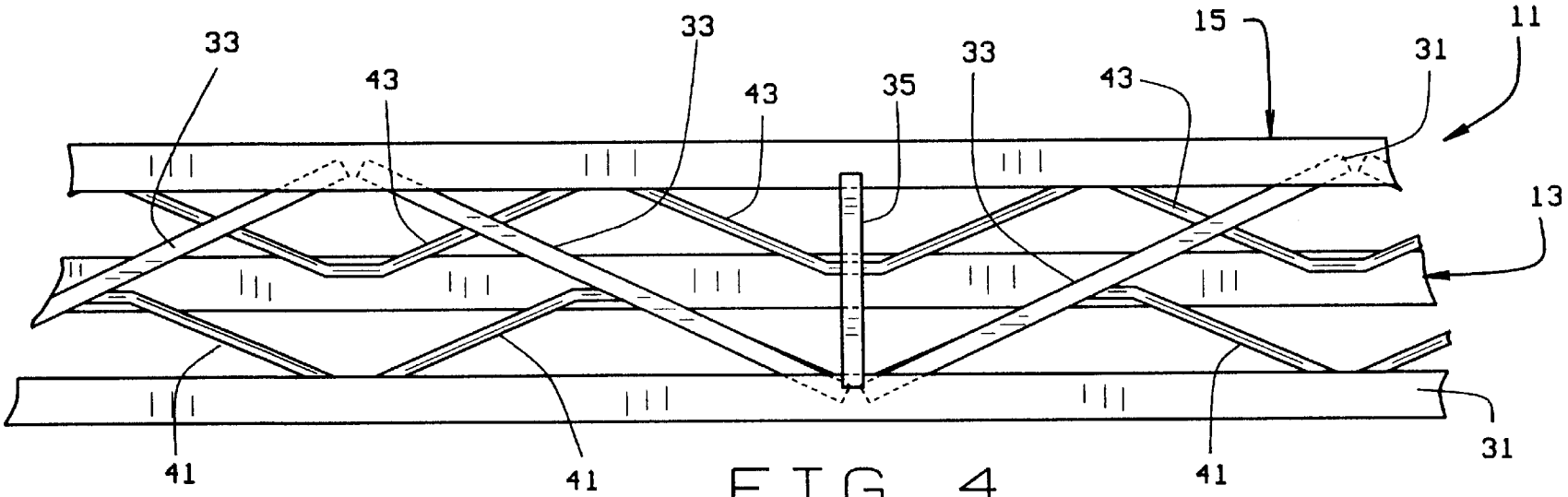
FIG. 4 is a top plan view of the beam and truss of the fall protection system.
Figure 5:
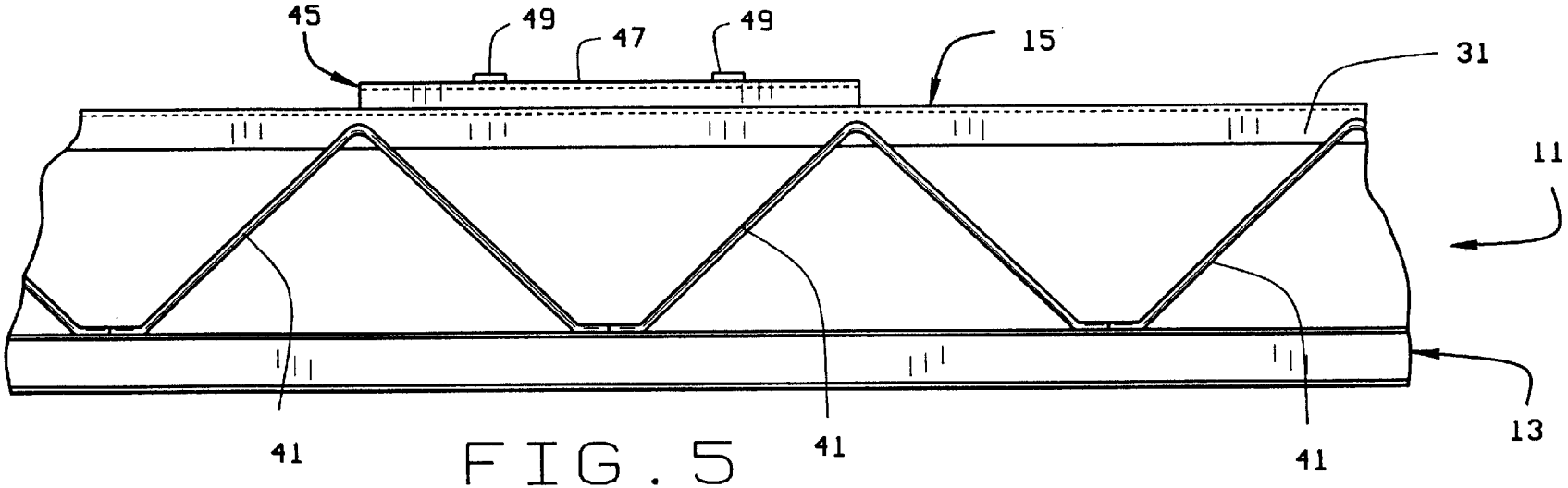
FIG. 5 is a side elevational view of the truss.

The rail assembly 11 is suspended from the top arm 9 of the supports 3 by a bracket assembly 45. The bracket assembly 45 includes a pair of elongate brackets 47 which are welded, or otherwise secured, to the frame members 31. The brackets 47 are right angle brackets and include a vertical leg 47*a* which extends up from the upper surface of the frame member leg 31*a* and a generally horizontal leg 47*b* which extends generally parallel to the frame member leg 31*a*. Although the brackets 47 are elongate (i.e., upwards of 36" long) the brackets 47 can be made shorter, depending on the manner of fixing the brackets to the frame members 31. The brackets 47 are secured to the frame members such that the bracket legs 47*b* are directed towards each other. A pair of spaced apart cross-members 49 are fixed to the bracket legs 47*b* and extend between the brackets 47. The brackets 47 can extend beyond the cross-members 49. That is, the cross-members can be positioned inwardly from the ends of the brackets 47, as seen in FIGS. 2 and 5. A U-bolt 51 extends about the outer surfaces of each support arm 9 and is bolted to the bracket cross-members 49. Thus, the rail assembly 11 is suspended from the supports 3 by the U-bolts 51 to which the bracket assembly 45 is connected. The legs 53 of the U-bolts extend downwardly through openings in the cross-members 49. The lower ends of the U-bolt legs 53 are threaded and accept nuts to hold the cross-members 49 (and hence the bracket 45 and rail system 11) to the U-bolt 51 (and hence the support 3). Although the connections between the elements of the bracket 45 are preferably made by welding, the connections between the elements can be made in other ways, for example, using bolts and nuts.

Under the conventional I-beam system, as noted above, the I-beam can sag or bend. Thus, the conventional I-beam system must include numerous closely spaced supports. Generally, supports are required every 6'–7' to prevent the I-beam of a conventional I-beam system from flexing or sagging. This need for frequently spaced supports drastically increases the cost of installation of a conventional system, as well as the time involved in installing the system. Thus, as noted above, its use has been limited substantially to situations where the system can be installed as part of a larger or pre-existing structure where the beam can be connected to the frame or structural components of a building.

In the present system, the truss 15 reinforces the I-beam 13 to enable the I-beam to span substantial lengths without the need for numerous or frequent supports. For example, the supports 3 can be spaced 25' apart and even 45' to 50' apart. Thus, a rail assembly 11 can be constructed which will span, for example, the full length of a rail car, as seen in FIG. 1, using only two supports 3, as shown. The fact that the closely spaced supports of the conventional system are not required for the present system, enables the present system to be installed much less expensively and much more quickly than the conventional I-beam systems. Further, the present system can be installed as a free standing system, and does not require that it be made part of an existing structure.

Further, the rigidity created in the rail assembly 11 by the truss 15 will substantially prevent the rail assembly 11 from bending or deflecting when a worker falls. Further, because the rail assembly will not bend or deflect when stressed, the loads transferred to the supports 3 when a worker falls will be substantially vertical.

In view of the above, it will be seen that the several objects and advantages of the present invention have been achieved and other advantageous results have been obtained. As various changes could be made in the above constructions without departing from the scope of the invention, it is intended that all matter contained in the above description or shown in the accompanying drawings shall be interpreted as illustrative and not in a limiting sense. For example, although a triangular truss is shown, the truss can be made other shapes. The frame members 31 and the bracket angles 47 can be roll formed to be one-piece unitary members. The bracket cross-members 49 could be eliminated and the U-bolts can be secured directly to the angle brackets 47. The I-beam 13 can be replaced simply with a flange, along which the trolley 19 can roll. Although the rail assembly 11 is shown in the drawings as being suspended from supports 3, the rail assembly could be supported above the structure by other means. For example, the rail assembly can be supported by braces which extend out from the wall of a building adjacent a rail road track. Alternatively, the rail assembly 11 can be suspended above a rail car, for example, by a structure which spans multiple rail road tracks, so that two or more rail assemblies can be positioned parallel to each other over the adjacent rail road tracks. These examples are merely illustrative.

What is claimed is:

1. A fall protection system comprising at least two spaced apart support members, a rigid rail assembly mounted to said support members to be positioned over a work area, a trolley slideable along said rail assembly, a lanyard suspended from said trolley, and a harness connected to an end of said lanyard and adapted to be worn by a worker;

said support members being spaced at least 10 feet apart and supporting said rail assembly above a structure to be traversed;

said rail assembly including a truss member suspended from said support members and a beam suspended from said truss member; said truss member including a truss frame having a first frame member and a second frame member; said first and second frame members extending generally horizontally substantially the full length of said beam and being horizontally spaced apart from each other and spaced vertically above said beam; said truss including a plurality of connecting members extending between said first and second frame members; said beam having a generally horizontal web and defining a track; said trolley being slideable along said track; said rail assembly being capable of arresting a workers fall with substantially no deflection of the rail assembly; the rail assembly transmitting the forces from the worker's fall to the support members, and applying substantially vertical forces to the support members.

2. The fall protection system of claim 1 wherein said support members are free standing support members, said support members including a generally vertical portion and an arm extending from said vertical portion over the structure.

3. The fall protection system of claim 1 wherein said support members are free standing; said free standing support members each including a vertical portion of a desired height and an arm extending outwardly from said vertical portion; said truss member being suspended from said support member arms.

4. The fall protection system of claim 1 wherein said connecting members zigzag between said first and second frame members to define a plurality of triangles.

5. The fall protection system of claim 4 said truss further including a second set of connecting members which are connected at a first end to said first frame member and are connected at a second end to said beam and a third set of connecting members which are connected at a first end to said second frame member and are connected at a second end to said beam.

6. The fall protection system of claim 5 wherein said second and third sets of connecting members zigzag between said frame members and said beam to define a plurality of triangles.

7. The fall protection system of claim 5 wherein said truss member generally defines a triangle in end elevation; the second ends of said second and third set of connecting members being substantially adjacent each other.

8. The fall protection system of claim 7 wherein said frame members include an upper leg and a lower leg, said upper leg being generally horizontal, said lower leg defining an acute angle with said upper leg; said second and third sets of connecting members being fixed to said lower legs of said frame members; said angle being sized to direct said second and third sets of connecting members to the approximate center of the beam.

9. The fall protection system of claim 8 wherein the second and third connecting members are fixed to the frame member lower legs over a substantial width of the frame member lower legs.

10. The fall protection system of claim 8 wherein the beam of the rail assembly comprises an I-beam, said beam including a vertical web extending upwardly from said horizontal web and an upper horizontal web extending across a top of said vertical web; said second ends of said second and third connecting members being operatively connected to said upper horizontal web.

11. The fall protection system of claim 10 wherein said second ends of said second and third connecting members are fixed directly to said beam upper web.

12. The fall protection system of claim 11 wherein said truss member is suspended from said support members by a bracket assembly; said bracket assembly including a bracket cross-member which extends between said frame assembly and a U-bolt to which said cross-members are connected; said U-bolt having a pair of legs connected by a spanner, said U-bolt spanner extending across a top surface of said support members, said U-bolt legs extending downwardly from said support members.

13. The fall protection system of claim 12 wherein said bracket includes a spacer on an upper surface of each said frame member, said bracket cross-member being mounted to said spacer, said spacer raising said bracket cross-member above a top of said truss member.

14. The fall protection system of claim 1 wherein the first and second frame members of the truss are spaced apart a distance at least twice the width of the track.

15. A fall protection system comprising at least two spaced apart support members extending at least partly over a structure to be traversed by a worker, a rail assembly mounted to said support members to be positioned over the structure, a trolley slideable along said rail assembly, a lanyard suspended from said trolley, and a harness connected to an end of said lanyard and adapted to be worn by the worker;

said support members being spaced at least 10 feet apart and supporting said rail assembly above the structure to be traversed;

said rail assembly including a truss member mounted to the support members and a beam mounted to an underside of said truss member; said truss member extending substantially the full length of said beam; said beam having a generally horizontal web; said trolley being slideable along said horizontal web;

said truss member including:

a first and a second horizontally spaced apart frame members spaced above said beam; said frame members comprising angle brackets having a first generally horizontal leg and a second leg depending from said first leg; said first and second legs defining an angle of less than about 90°;

a first set of connecting members extending between said first and second frame members and being fixed to said first legs of said frame members, said connecting members zigzagging between said first and second frame members to define a plurality of triangles;

a second set of connecting members having a first end fixed to said first frame member second leg and a second end operatively connected to said beam; said second set of connecting members zigzagging between said first frame member and said beam to define a plurality of triangles; and a third set of connecting members having a first end fixed to said second frame member second leg and a second end operatively connected to said beam; said third set of connecting members zigzagging between said second frame member and said beam to define a plurality of triangles;

said truss being capable of withstanding the sudden impact of a worker's fall with substantially no deflection of the truss; the truss transmitting the forces from the worker's fall to the support members, and applying the forces to the support members substantially vertically.

* * * * *